US008590071B1

(12) United States Patent
Lopez

(10) Patent No.: US 8,590,071 B1
(45) Date of Patent: Nov. 26, 2013

(54) RECIPROCATING IN-FLOOR POOL CLEANER HEAD

(71) Applicant: Pool Patch LLC, Phoenix, AZ (US)

(72) Inventor: Thomas V. Lopez, Phoenix, AZ (US)

(73) Assignee: Pool Patch LLC, Phoenix, AZ (US)

( * ) Notice: Subject to any disclaimer, the term of this patent is extended or adjusted under 35 U.S.C. 154(b) by 0 days.

(21) Appl. No.: 13/764,202

(22) Filed: Feb. 11, 2013

(51) Int. Cl.
*E04H 4/00* (2006.01)

(52) U.S. Cl.
USPC ..... 4/490; 4/492; 4/496; 239/204

(58) Field of Classification Search
USPC ..... 4/490, 492, 496; 239/204
See application file for complete search history.

(56) References Cited

U.S. PATENT DOCUMENTS 4,322,860 A 4/1982 Gould
4,466,142 A 8/1984 Gould
6,601,244 B1 * 8/2003 Goettl ..... 4/490
6,971,588 B1 12/2005 Tarr et al.
7,571,496 B2 * 8/2009 Martin ..... 4/490
2011/0225716 A1 9/2011 Malinasky

* cited by examiner

*Primary Examiner* — Tuan N Nguyen
(74) *Attorney, Agent, or Firm* — Thomas W. Galvani, P.C.; Thomas W. Galvani

(57) ABSTRACT

A device for use in a swimming pool structure, the swimming pool structure including a circulation system having a piping assembly and a pump for cyclically communicating water through the piping assembly. The device includes an insert coupled in fluid communication to the piping assembly, a piston carried within the insert for reciprocal movement between a lowered position and a raised position in which the piston is above the insert, a nozzle in the piston is unobstructed, and the piston is in one of a plurality of indexed orientations. The piston rotates to an adjacent indexed orientation in response to reciprocation between the raised and lowered positions in response to the cyclical application of water through the chamber. Upper and lower engagement assemblies prevent rotational movement of the piston with respect to the insert in the raised and lowered positions of the piston.

25 Claims, 5 Drawing Sheets

RECIPROCATING IN-FLOOR POOL CLEANER HEAD

FIELD OF THE INVENTION

The present invention relates generally to swimming pool cleaning systems, and more particularly to cleaner heads used in in-floor cleaning systems.

BACKGROUND OF THE INVENTION

Some swimming pool structures are constructed with cleaning systems in which cleaner heads are installed in the floor and steps of the pool and direct jets of water across the inner surface of the pool to move debris collected on the inner surface toward a drain, where the debris is drawn into a circulation system for filtering. The circulation system typically includes the drain, an intake or upstream piping assembly coupled to the drain, and a pump for drawing water into the drain and through the upstream piping assembly to a filter for filtration. Filtered water is then communicated out through an outlet or downstream piping assembly to the heads installed in the floor and steps of the pool. The heads are applied to collars mounted in the floor of the pool structure in fluid communication with the piping assembly. The collars are generally installed flush with the floor of the pool.

Various manufacturers have developed several designs for cleaner heads. One commonly-used head includes a cylindrical insert carrying a piston formed with a nozzle. A guide pin extending from a sidewall of the piston navigates a sinusoidal maze on the inner surface of the insert, and as the guide pin moves through the maze in response to the flow of water through the head, the piston moves up, down, and in rotation, sequentially moving through several nozzle stations or orientations. Water applied through the head is thus directed in different directions in response to movement of the piston. This head, however, is prone to wear and breaking. The pin often snaps off, so that the piston then freely rotates within the insert without guidance. Further, as mineral deposits build up and some debris inevitably passes through the filter into the head, the maze often becomes clogged and prevents the piston from moving. The piston will thus become stuck in an up, down, or partially raised position, requiring maintenance. The piston can also become stuck when this build-up or debris becomes lodged between the piston and the insert. Further, because most pool cleaning systems are programmed to operate at night, away from the pool owner's watch, a stuck head will often go unnoticed and can cause a portion of a pool surface to remain uncleaned for a significant period of time. An improved cleaner head for in-floor pool installations is needed.

SUMMARY OF THE INVENTION

According to the principle of the invention, a device is useful in a swimming pool structure to clean the surface of the swimming pool structure. The swimming pool structure includes a pool and a circulation system having a piping assembly and a pump for cyclically communicating water through the piping assembly between the pool and the pump. The piping assembly terminates in a collar installed in the wall of the swimming pool structure.

The device includes a piston which is carried for reciprocation within a chamber in an insert applied to the collar. The piston reciprocates between a lowered position and a raised position in which the piston is in one of a plurality of indexed orientations, and a nozzle formed in the piston is free of obstruction above the insert. The piston rotates to an adjacent indexed orientation in response to reciprocation of the piston between the raised and lowered positions in response to the cyclical application of water flow through the chamber from an inlet in the chamber to the nozzle. Upper and lower engagement assemblies prevent rotational movement of the piston with respect to the insert in the raised and lowered positions, respectively, of the piston.

BRIEF DESCRIPTION OF THE DRAWINGS

Referring to the drawings.

DETAILED DESCRIPTION

Figure 1:
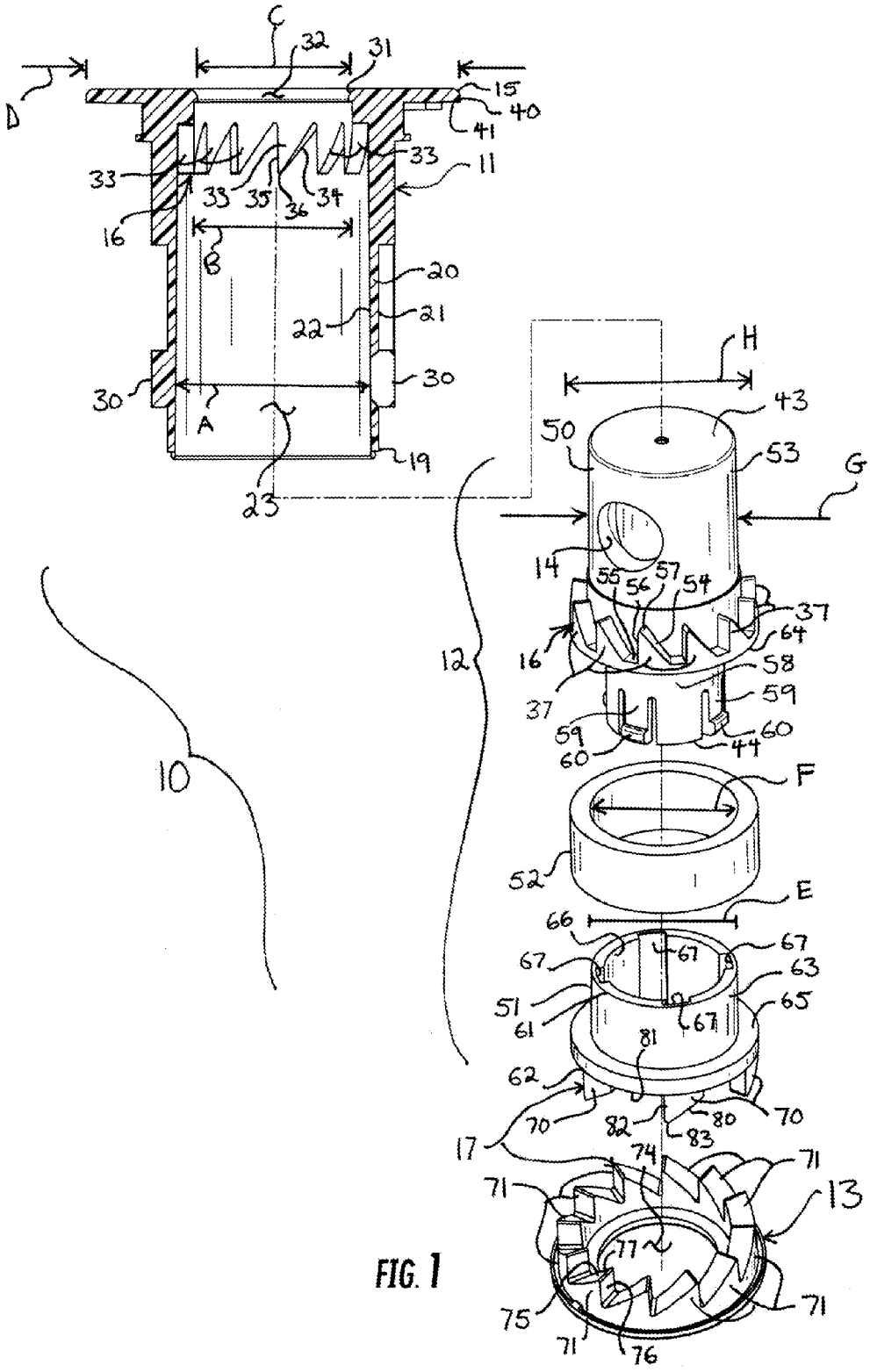
FIG. 1 is a combined section and top perspective view of an in-floor pool cleaner head structured and arranged according to the principle of the invention, and including an insert, a piston body, a weight, a cap to the piston body, and an end cap, the insert shown in section view and the body, weight, cap, and end cap shown in top perspective view.
Figure 3A:
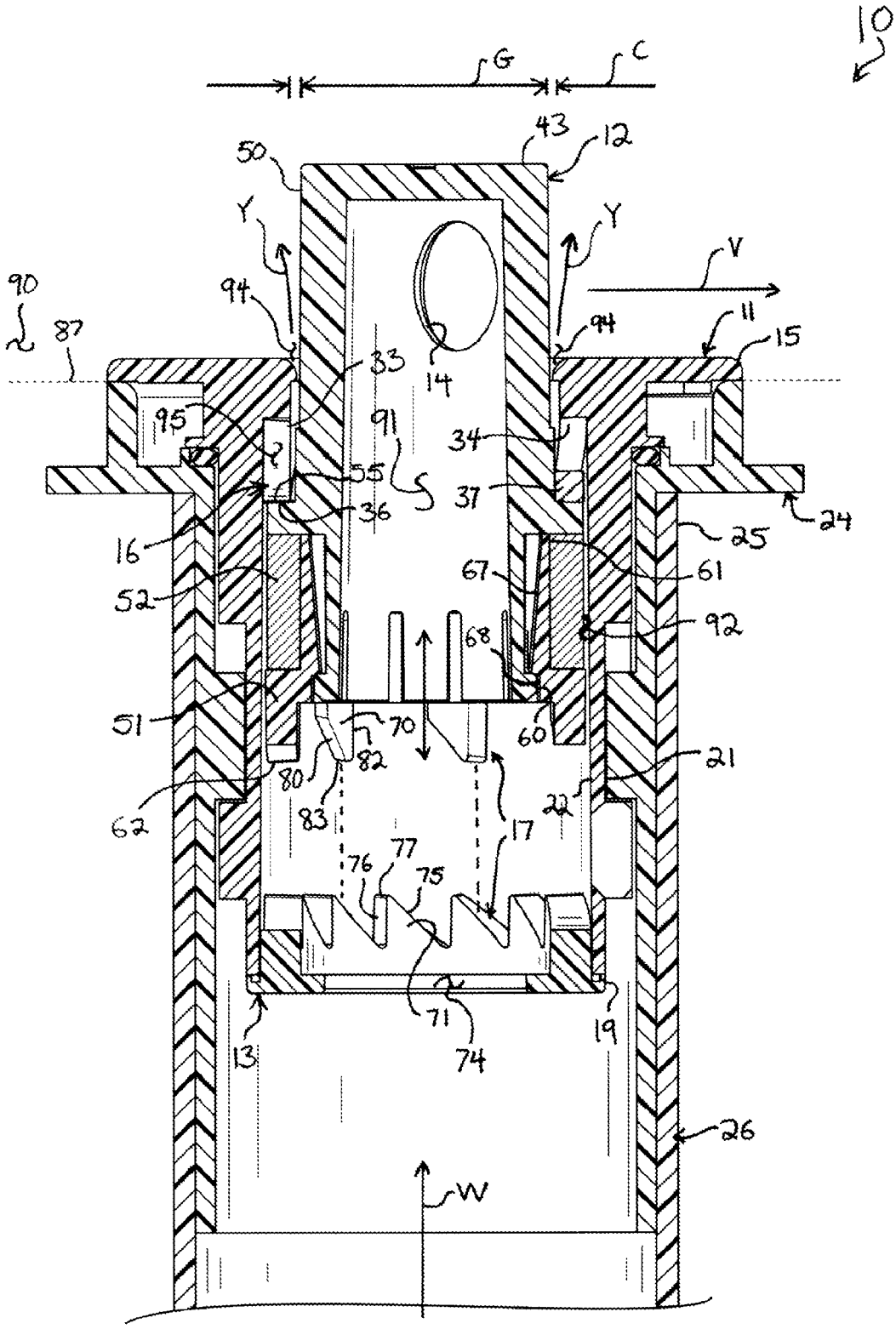
FIGS. 3A-3C are section views of the head of FIG. 1 taken along the line 3-3 in FIG. 2, showing the piston in a raised position and a first raised indexed orientation, a lowered position and a first lowered indexed orientation, and a raised position and a second raised indexed orientation, respectively.
Figure 3B:
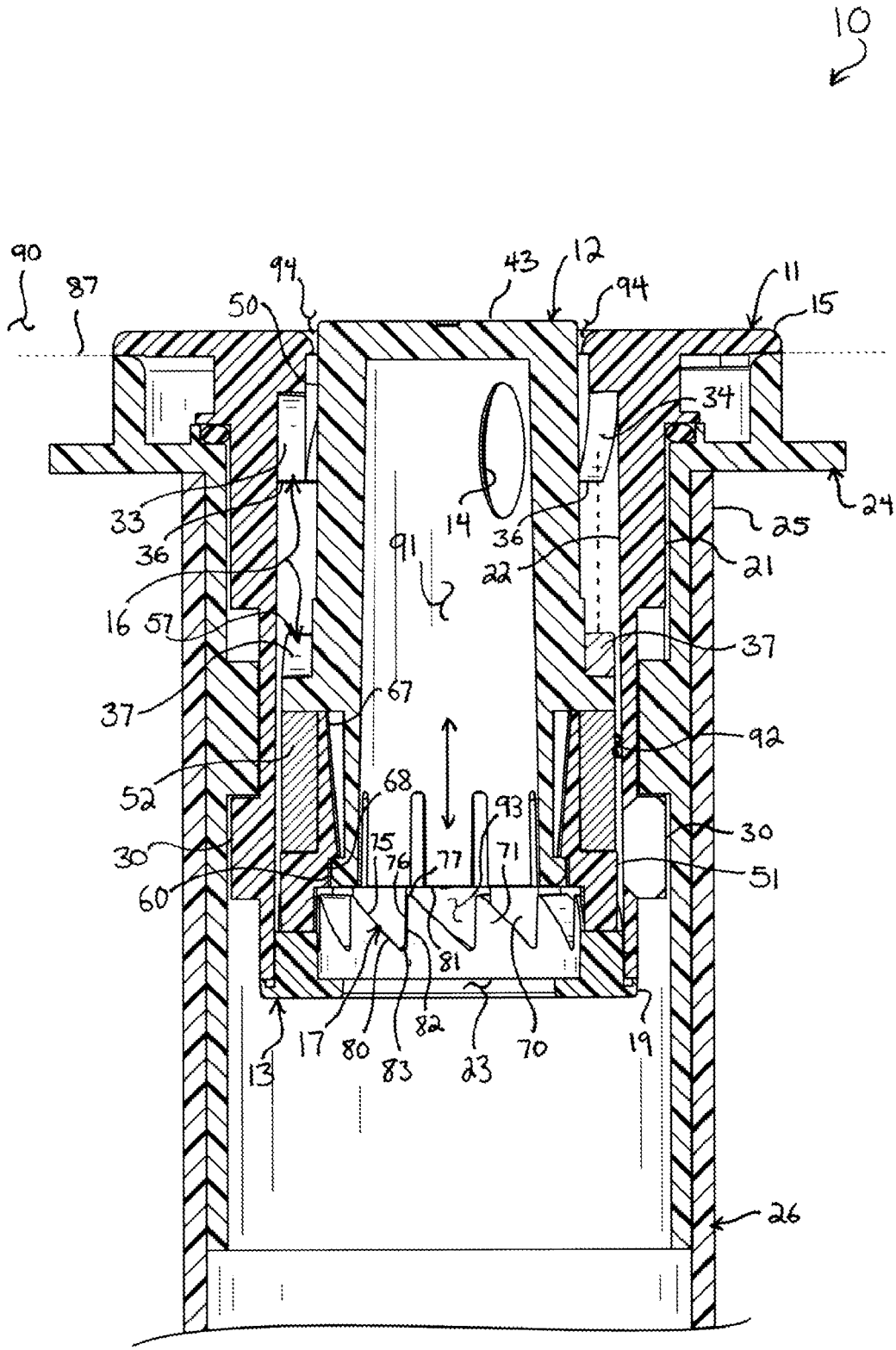
Figure 3C:
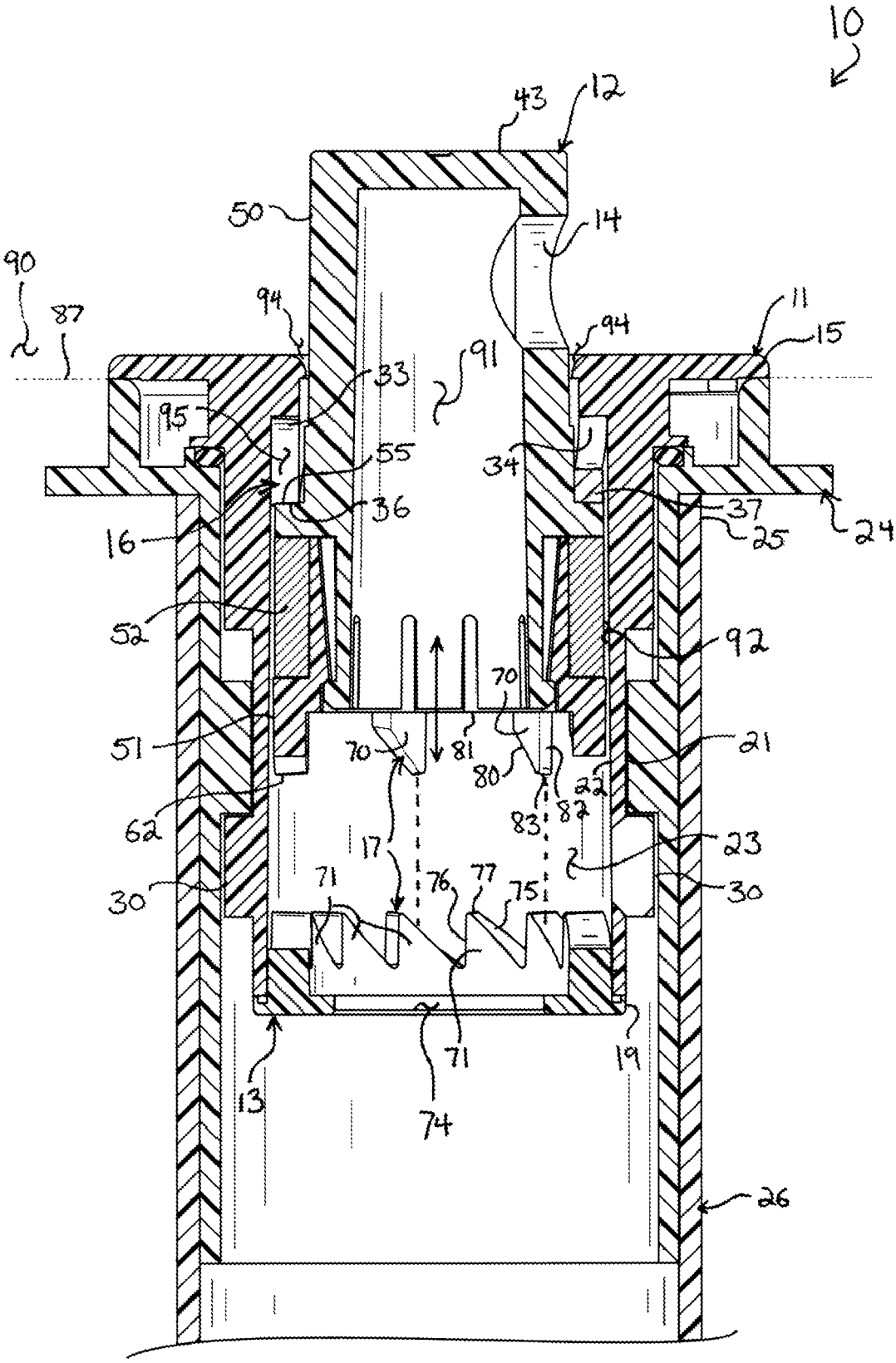

Reference now is made to the drawings, in which the same reference characters are used throughout the different figures to designate the same elements. FIG. 1 illustrates in exploded view a reciprocating in-floor pool cleaner head 10, constructed and arranged in accordance with the present invention. The head 10 generally includes a generally cylindrical insert 11, a generally cylindrical piston 12 carried in the insert 11, and an end cap 13. The head 10 is useful for cleaning a pool surface in a plurality of radial directions. Water is cyclically communicated to the head 10 to impart reciprocation to the piston 12 between a raised position and a lowered position. In response to water being applied to the head 10, the piston 12 moves into the raised position, in which the piston 12 extends partially out of the insert 11, so that a major outlet or nozzle 14 is exposed above a top 15 of the insert 11 and the piston 12 is therein locked into a first raised indexed orientation by an upper engagement assembly 16 carried between the insert 11 and the piston 12, as shown in FIG. 3A. As the application of water is later removed from the head 10, the piston 12 lowers into the lowered position, and a lower engagement assembly 17, separate from the upper engagement assembly 16, engages and rotates the piston 12 slightly in a clockwise direction with respect to the first raised indexed orientation into an adjacent first lowered indexed orientation, as shown in FIG. 3B. Later, in response to the re-application of water to the head 10, the piston 12 rises again to the raised position, and the upper engagement assembly 16 engages and rotates the piston 12 slightly in a clockwise direction with respect to the first lowered indexed orientation, therein locking the piston 12 in an adjacent second raised indexed orientation, as shown in FIG. 3C.

Figure 2:
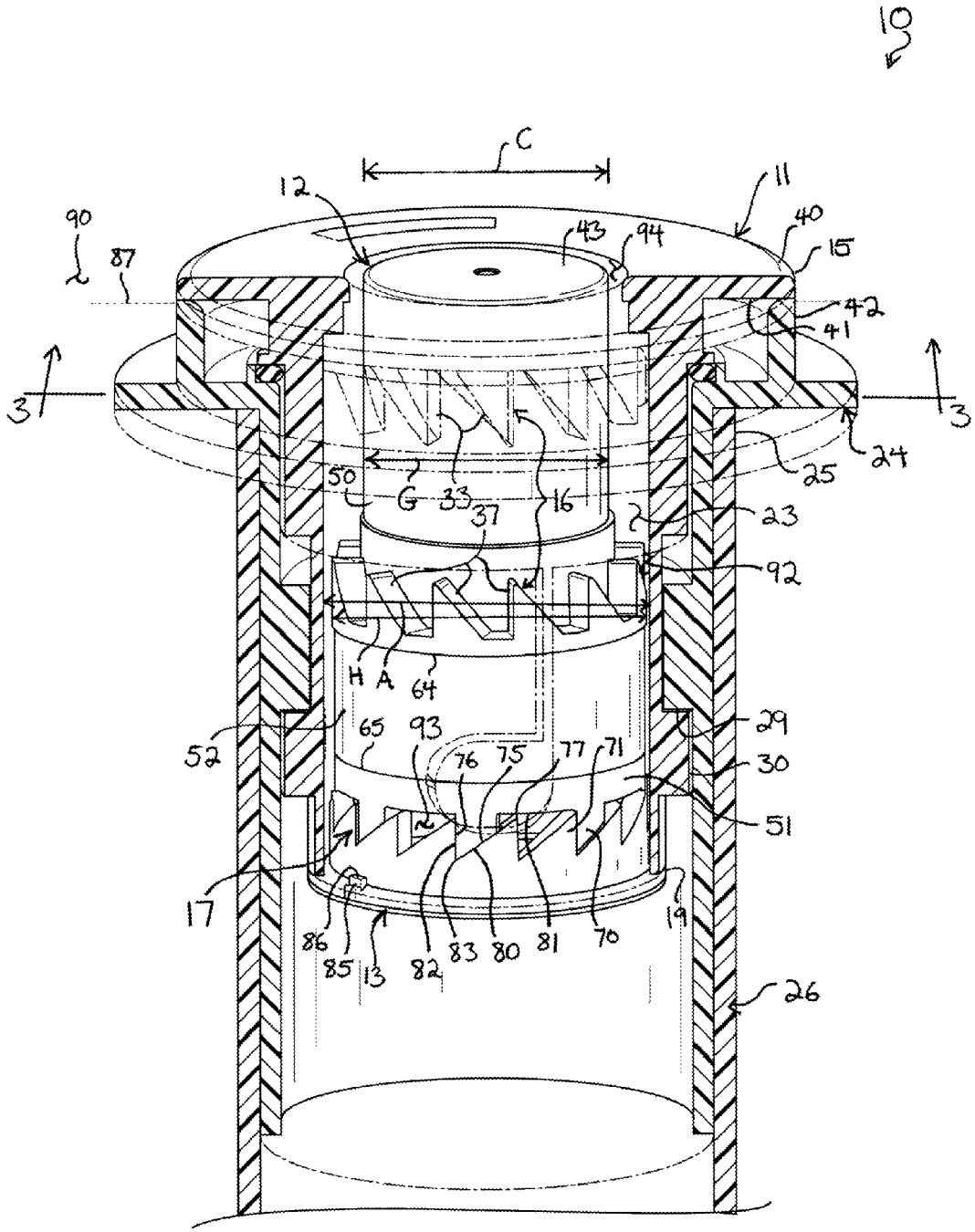
FIG. 2 is a partial section view of the head of FIG. 1 showing the insert, body, weight, cap, and end cap applied to a collar in a piping assembly.

Returning to FIG. 1, the insert 11 alone is shown in a section view bifurcating the insert 11. The insert 11 includes a generally cylindrical body 18 having the top 15, an opposed open bottom 19, and a continuous sidewall 20 extending between the top 15 and bottom 19. The sidewall 20 includes an outer surface 21 and an opposed inner surface 22, which, together with the top 15 of the insert 11 and the end cap 13 coupled to the bottom 19 of the insert 11, bound and define a generally cylindrical chamber 23 within the insert 11. In an installed condition, as shown in FIG. 2, the outer surface 21 of the insert 11 is received against a collar 24 applied to a terminal end 25 of a piping assembly 26 coupled to a pump and circulation system of a swimming pool structure, so that water is communicated through the piping assembly 26 and into the chamber 23 of the insert 11. The insert 11 includes tabs 30 which lock into corresponding grooves 29 formed in the collar 24, as shown in FIG. 2. One having reasonable skill in the art will understand the conventional structure of a swimming pool structure with a pump, circulation system, and piping assembly terminating in a collar, and as such, said structure is not shown or described.

The top 15 of the insert 11 is formed with a mouth 31 bounding a circular opening 32 leading into the chamber 23. The mouth 31 extends radially inward into the opening 32 from the sidewall 20 of the insert 11 along the top 15. A set of teeth 33, defining an engagement element of the upper engagement assembly 16, are formed along the inner surface 22 of the insert 11, are directed downward from the mouth 31, and are oriented with faces 34 in a clockwise direction when the insert 11 is viewed from a top 15-up orientation. The teeth 33 have backs 35 and tips 36. There are preferably twelve teeth 33, and the teeth 33 are structured and arranged for engaging with a complemental set of preferably twelve teeth 37 carried on the piston 12 when the piston 12 is in the raised position. The chamber 23 defines an inner diameter A, the teeth 33 define an inner diameter B, and the mouth 31 defines an inner diameter C, as indicated in FIG. 1, and the diameter A is greater than the diameter B, and the diameter B is greater than the diameter C.

Still referring to FIG. 1, the top 15 of the insert 11 has a thin, annular flange 40 extending radially outward from the sidewall 20. The flange 40 has a diameter D which is greater than the diameters A, B, and C, and has a lower surface 41 which is flat. In an installed condition of the head 10, shown in FIG. 2, the diameter D of the flange 40 is coextensive with the diameter of an upstanding lip 42 on the collar 24, so that the lower surface 41 of the flange 40 lies on top of and conceals the upstanding lip 42. The collar 24 is frequently a different color than that of the swimming pool structure, and so the flange 40 covers and conceals the discrepancy in color. The flange 40 has a one of a plurality of colors, which is selected to match or correspond to the color of the floor to provide a pleasing or subtle aesthetic. The insert 11 is constructed from a material or combination of materials having rigid, strong, durable, and corrosion- and oxidation-resistant material characteristics, such as acrylonitrile butadiene styrene ("ABS") or a similar plastic. The insert 11 has a matte finish to resist oxidation of the surface of the insert 11.

The piston 12 includes a closed top 43 and an opposed open bottom 44, a generally cylindrical body 50, a cap 51 releasably coupled to the body 50, and an annular weight 52 carried between the body 50 and the cap 51. The body 50 of the piston 12 has a cylindrical sidewall 53 with an outer diameter G. The sidewall 53 extends from the top 43 of the piston 12 to the set of teeth 37 which define a complemental engagement element of the upper engagement assembly 16 for engagement with the teeth 34 when the piston 12 is in the raised position. The body 50 of the piston 12 has a diameter H across the teeth 37. The teeth 37 are directed upward toward the top 43 of the piston 12, and are oriented with faces 54 in a counter-clockwise direction when the piston 12 is viewed from a top 43-up orientation. Each tooth 37 in the set of teeth 37 is separated by a bottom land 55 and has a back 56 and a tip 57.

The body 50 terminates in a stem 58 carried between the teeth 37 and the bottom 44, and is slotted to define tabs 59 for snappedly receiving the cap 51 to hold the weight 52 between the body 50 and the cap 51. The tabs 59 are circumferentially spaced apart from each other at approximately ninety degrees, and each tab 59 is angled radially outward so as to project slightly beyond the stem 58 and terminate in an enlarged head 60. The body 50 is constructed of a material or combination of materials having rigid, strong, durable, and corrosion- and oxidization-resistant material characteristics, such as ABS or a similar plastic. The tabs 59 are constructed of a material having flexible and shape-memory characteristics, such as plastic, which allows the tabs 59 to repeatedly flex and return to an original shape and position.

Still referring to the exploded view of FIG. 1, the cap 51 is structured to receive the weight 52 and fit over the stem 58. The cap 51 has an open top 61, an opposed open bottom 62, and a neck 63 with an outer diameter E corresponding to an inner diameter F of the weight 52. The weight 52 is fitted onto the cap 51, tightly encircles the neck 63, and is prevented from moving radially on the neck 63 by the outer diameter E. When the cap 51 is applied onto the stem 58 of the body 50, a shoulder 64 formed between the teeth 37 and the stem 58 on the body 50 cooperates with a shoulder 65 on the cap 51 to bound and prevent lateral movement of the weight 52 on the neck 63. An inner surface 66 of the neck 63 of the cap 51 is formed with axial grooves 67 for receiving the tabs 59 of the body 50 of the piston 12, and the grooves 67 terminate in the shoulder 65 at notches 68 (shown in FIGS. 3A-3C) that snappedly receive the enlarged heads 60 of the tabs 59. Moreover, as seen in FIG. 3A, each groove 67 tapers inwardly from the top 61 to the bottom 62 of the cap 51 to bend each enlarged head 60 inwardly until the head 60 is received in the notch 62 into which the head 60 snaps and locks to prevent relative rotational movement of the cap 51 and the body 50.

Referring back to FIG. 1, the lower engagement assembly 17 is formed of a set of teeth 70 carried on the cap 51 of the piston 12 and a complemental set of teeth 71 carried on the end cap 13. The end cap 13 has an annular base 72 defined by an outer lip 73 and an opening 74 formed through the end cap 13 to allow water to flow through the end cap 13. The opening 74 is an inlet to the head 10 to communicate water from the piping assembly 26 the chamber 23 and through the head 10. The teeth 71 extend axially upward away from the base 72 of the end cap 13 and are oriented with faces 75 in a clockwise direction when the end cap 13 is viewed from a teeth 71-up, base 72-down orientation. There are preferably twelve teeth 71, each tooth 71 having a face 75, an opposed back 76, and a tip 77. The set of teeth 70 has preferably six teeth, half the number of teeth as the set of teeth 71. The teeth 70 are formed on the shoulder 65 and extend downwardly away from the cap 51. The teeth 70 have faces 80 oriented in a counter-clockwise direction when the cap 51 is viewed from a neck 63-up orientation, and the teeth 70 are spaced apart by bottom lands 81. Each tooth 70 has a face 80, an opposed back 82, and a tip 83.

The end cap 13 is secured to the insert 11 to form a housing. With momentary reference to FIG. 3A, an upstanding post 85 on the lip 73 of the end cap 13 closely fits into a corresponding notch 86 in the insert 11 to prevent rotational movement of the end cap 13 with respect to the insert 11 when the piston 12 moves into the lower position thereof and the teeth 70 on the piston 12 engage with the teeth 71 on the end cap 13. The end cap 13 is secured in a friction-fit engagement, and is further secured by adhesive, ultrasonic welding, or like fastening mechanism.

The head is easy to assemble and operate. FIG. 2 illustrates the head 10 installed in the collar 24 applied to the terminal end 25 of the piping assembly 26. The tabs 30 of the insert 11 are locked into the collar 24. The collar 24 and the piping assembly 26 are applied in the pool structure 87. The pool structure 87, the piping assembly 26, the collar 24, and the insert 11 are shown in broken line so as to allow clear illustration of the various structures and features of the piston 12. The pool holding water is marked with the reference character 90.

To assemble the head 10 in the condition shown in FIG. 2, and with reference to the structure shown in FIGS. 1 and 3A, the weight 52 is passed onto the neck 63 of the cap 51 so that the weight 52 encircles the neck 63. The weight 52 is snugly disposed between the shoulders 64 and 65 of the body 50 and the cap 51, respectively, and is free to rotate on the neck 63 of the cap 51 but is prevented from coming off of the piston 12 and from reciprocating axially on the neck 63. The cap 51 and weight 52 are then aligned with the stem 58 of the body 50 of the piston 12. The tabs 59 are aligned with the axial grooves 67 formed on the inner surface 66 of the cap 51, and the cap 51 is moved over the stem 58, with the grooves 67 slidably receiving the tabs 59 until the enlarged heads 60 of the tabs 59 snap into the notches 68 at the end of the grooves 67 proximate to the 62 of the cap 51. With the tabs 59 snappedly received in the notches 68, the cap 51 is secured onto the body 50, and a blind fluid communication bore 91 (shown in FIG. 1) is formed centrally through the piston 12 from the open bottom 62 of the end cap to the closed top 43 of the piston 12 body 50. The fluid communication bore 91 is in fluid communication with the nozzle 14 formed in the sidewall 53 of the body 50. The piston 12 is ready for application into the chamber 23. The top 43 of the piston 12 is applied through the open bottom 19 of the insert 11 until the top 43 is disposed in the opening 32 between the mouth 31 at the top 15 of the insert 11, and the bottom 62 of the piston 50 cap 51 is proximate to the bottom 19 of the insert 11. The end cap 13 is then applied to the bottom 19 of the insert 11 in a friction-fit engagement, forming the chamber 23 therebetween, and the end cap 13 is prevented from rotation on the insert 11 by the interaction of the post 85 on the end cap 13 in the notch 86 in the insert 11.

With the piston 12 carried in the insert 11, the head 10 is applied to the collar 24. The collar 24 is pre-installed in the pool structure 87, having been installed during the formation of the pool structure 87, likely when the pool structure 87 was initially constructed. Generally, the upstanding lip 42 is flush with the surface of the pool structure 87. The head 10 is inserted into the collar 24, with the end cap 13 presented first, and the tabs 30 formed on the outer surface 21 of the insert passing into grooves in the collar. The head 10 is completely inserted into the collar 24, so that the flange 40 is over the upstanding lip 42 of the collar 24 and the lower surface 41 of the flange 40 lies on top of and conceals the upstanding lip 42 and is flush with the surface of the pool structure 87. The insert 11 is then rotated to lock the tabs 30 into the grooves in a conventional and well known-manner, thereby securely engaging the head 10 in the collar 24.

As shown in FIG. 2, the head 10 is now arranged in an assembled condition ready for operation, and includes the piston 12 carried within the chamber 23 for reciprocal movement, the end cap 13 applied to the bottom 19 of the insert 11, and the weight 52 carried on the cap 51 which is secured on the body 50 of the piston 12. The piston 12 is arranged in FIG. 2 in the lowered position thereof with the nozzle 14 directed out of the back of the page. The diameter G of the sidewall 53 is just less than the inner diameter C of the mouth 31 and is less than the inner diameter A of the chamber 23, and the diameter H of the body 50 across the teeth 37 is just less than the inner diameter A of the chamber 23, so that an annular volume or gap 92 is formed between the insert 11 and the piston 12. The lower engagement assembly 17 is engaged, with the faces 80 of the teeth 70 of the piston 12 in contact with the faces 75 of the teeth 71 of the end cap 13, with the backs 82 of the teeth 70 of the piston 12 in contact with the backs 76 of the teeth 71 of the end cap 13, with the tips 83 of the teeth 70 of the piston 12 in contact between the faces 75 and the backs 76, and with the tips 77 of the teeth 71 in contact against the bottoms lands 81. Ports 93 are formed in the lower engagement assembly 17 in fluid communication with the chamber 23 and the gap 92 when the teeth 70 and 71 come together, the ports 93 being defined between the bottom lands 81 of the body 50 and the faces 75 of the end cap 13. The ports 93 extend radially through the lower engagement assembly 17 proximate to the bottom 19 of the insert 11 to communicate water radially through the lower engagement assembly 17.

Operation of the head 10 will now be discussed with reference to FIG. 2 and FIGS. 3A-3C. Water is cyclically applied through the head 10 from the piping assembly 26. When the application of water is removed from the head 10, the head 10 moves into the lowered position of the piston 12, as illustrated in FIG. 2. When the application of water is returned to the head 10, water flows into the collar along a direction indicated by line W in FIG. 3A and through the opening 74 in the end cap 13 at the bottom 19 of the insert 11. Water moves into the chamber 23 and into the fluid communication bore 91, contacting the top 43 of the piston 12. In response to water being applied to the piston 12, the piston 12 moves into the raised position. In FIG. 3A, the piston 12 is in a first of twelve raised indexed orientations, wherein the term "orientation" is used to describe the angular direction of the nozzle 14 of the piston 12, and each raised orientation is indexed because the piston 12 rotates sequentially among discrete, discontinuous orientations in response to the twelve teeth 37 of the piston 12 body 50 enmeshing with the twelve teeth 33 of the insert 11 in twelve discrete, discontinuous arrangements as the piston 12 reciprocates between the raised and lowered positions.

In the raised position of the piston 12, shown in FIG. 3A, the nozzle 14 is above the top 15 of the insert 11 and free of obstruction, water flows through the fluid communication bore 91 of the piston 12 and out the nozzle 14. The nozzle 14 directs a pressurized stream of water along line V across the surface of the pool structure 87, and as the nozzle 14 is rotated into each adjacent orientation, it directs the pressurized stream of water across an adjacent portion of the surface. Water also flows around the piston 12 to exit through a minor outlet 94 at the top 15 of the insert 11. The outlet 94 is an annular gap formed between the diameter G of the piston 50 sidewall 53 and the inner diameter C of the mouth 31. The outlet 94 is in fluid communication with the chamber 23 for communication of water from the chamber 23 out of the piston 12. When the piston 12 is in the raised position and the twelve teeth 37 of the piston 12 body 50 are engaged with the twelve teeth 33 of the insert 11, ports 95 are formed between the teeth 33 and 37 allowing water to flow radially through the upper engagement assembly 16. The set of teeth 37 include bottom lands 55 against which the tips 36 of the teeth 33 are in contact, and the ports 95 are formed between the bottom lands 55, the faces 34 of the teeth 33, and the backs 35 of the teeth 33. As water is applied to the head 10 and enters the chamber 23, the water passes into the gap 92 encircling the piston 12 and spacing the piston 12 apart from the inner surface 22 of the insert 11, through the ports 95, and then through the gap 94 into the pool 90 along line Y. Debris that may be carried into the head 10 and later collects on the head 10 when the pump is not in operation or water is not being applied to the head 10, such as between the insert 11 and the piston 12, is thus moved through the head 10, preventing the piston 12 from becoming stuck in the insert 11 in the raised position as from debris, corrosion, or other mineral or material buildup. Additionally, with a port 95 formed between each of the teeth 33 and 37, each tooth 33 and 37 is cleaned of debris when the piston 12 moves into the raised position.

The teeth 33 are offset from the teeth 71, and in the raised position, the teeth 70 of the lower engagement assembly 17 are offset from the teeth 71, as indicated by the broken lines extending between the teeth 70 and 71 in FIG. 3A. The engagement assembly formed between the teeth 33 meshingly engaged to the teeth 37 prevents rotational movement of the piston 12 and the nozzle 14 with respect to the insert 11 in the raised position of the piston 12.

When the application of water is removed from the head 10, the piston 12 moves out of the raised position and toward the lowered position (shown in FIG. 3B). The weight 52 has a density greater than water, so the weight 52 biases the piston 12 to fall under gravity into the lowered position. As the piston 12 moves toward the lowered position, the upper engagement assembly 16 disengages and the teeth 33 and 37 separate. The tips 83 of the teeth 70 of the lower engagement assembly 17 are aligned above the faces 75 of the teeth 71. The piston 12 descends straight down within the insert 11 confined by the inner surface 22, and the tips 83 of the teeth 70 encounter the faces 75 of the teeth 71 and slide down the faces 75 until the tips 83 are received between the faces 75 of the teeth 71 and the backs 76 of the teeth 71, so that the teeth 70 are engaged with the teeth 71, as shown in FIG. 3B, and prevented from relative rotational movement. Meshing engagement of the teeth 70 and 71 prevents rotational movement of the piston 12 and the nozzle 14 with respect to the insert 11 in the lowered position of the piston 12.

In the lowered position, the ports 93 are formed between the teeth 70 and 71 allowing water to flow through the lower engagement assembly 17. Although water is not being forcibly applied through the head 10 by the pump, some water may pass through the head, such as at the completion or beginning of movement from the raised or lowered position, respectively, or if a swimmer causes a submerged pulse or wave of water to moved against the head 10. The ports 93 allow water to pass through the head 10 among the chamber 23, the gap 92, and the fluid communication bore 91. Water moves into the head 10 by entering through the secondary outlet 94 and then into the nozzle 14, and also by entering through the secondary outlet 94, into the gap 92 between the piston 12 and the inner surface 22 of the insert 11, and then through the ports 93. Similarly, water moves out of the head 10 by passing through the fluid communication bore 91, out the nozzle 94, and out the secondary outlet 94, and also by moving through the ports 93, through the gap 92, and out the secondary outlet 94. In this way, the ports 93 allow water to move through the head 10 while the piston 12 is in the lowered position without moving the piston 12 to the raised position, so that debris that may collected on the head when the pump is not in operation or water is not being applied to the head 10, such as between the insert 11 and the piston 12, is thus moved through the head 10, preventing the piston 12 from becoming stuck in the insert 11 in the lowered position as from debris, corrosion, or other mineral or material buildup.

In FIG. 3B, the piston 12 is in a first of twelve lowered indexed orientations, wherein each of the lowered orientation is indexed because the piston 12 rotates sequentially among discrete, discontinuous orientations in response to the six teeth 70 of the piston 12 cap 51 enmeshing with the twelve teeth 71 of the end cap 13 in twelve discrete, discontinuous arrangements as the piston 12 reciprocates between the raised and lowered positions. The first lowered indexed orientation of the piston 12 is angularly offset from the first raised indexed orientation, as can be seen by the incremental rotation of the nozzle 14 in a clockwise direction from FIG. 3A to FIG. 3B. Movement of the piston 12 from the raised position to the lowered position thus rotates the piston 12 one half step, and movement from the lowered position to the raised position rotates the piston 12 another half step, as will now be explained, so that movement of the piston 12 from the raised position to the lowered position and back to the raised position rotates the piston 12 one full step, which is one of twelve steps of a full revolution of the piston 12 with respect to the insert 11. With each half step, the piston moves to an adjacent, subsequent indexed orientation.

In the lowered position of the piston 12, the nozzle 14 is just inboard of the top 15 of the insert. The teeth 33 and 37 of the upper engagement assembly 16 are spaced apart from each other, and the teeth 33 are offset from the opposed teeth 37, as indicated by the broken line extending between the teeth 33 and 37.

As water is cyclically applied from the piping assembly 26, the flow of water is returned to the head 10, causing the piston 12 to move back into the raised position, shown in FIG. 3C. As the piston 12 moves toward the raised position, the lower engagement assembly 17 disengages and the teeth 70 and 71 separate. The tips 57 of the teeth 37 of the upper engagement assembly 16 are aligned below the faces 34 of the teeth 33. The piston rises straight up within the insert 11 confined by the inner surface 22, and the tips 57 of the teeth 37 encounter the faces 34 of the teeth 33 and slide up the faces 34 until the tips 57 of are received between the faces 34 and the backs 35 of the teeth 33, so that the teeth 37 are engaged with the teeth 33, as shown in FIG. 3C, and prevented from relative rotational movement. Likewise, the tips 36 are received between the faces 54 and the backs 56 of the teeth 37. In this position, the ports 95 are again formed, though between a different combination of teeth 33 and 37. As before in the first raised indexed orientation, debris that may be carried into the head 10 and that may collect on the head 10, and especially between the insert 11 and the piston 12 is moved through the head 10, preventing the piston 10 from becoming stuck in the raised position. Each tooth 33 and 37 is cleaned of debris when the piston 12 moves into the raised position.

In FIG. 3C, the piston 12 is in a second of twelve raised indexed orientations. The teeth 33 and 37 are meshingly engaged, preventing rotational movement of the piston 12 and the nozzle 14 with respect to the insert 11. The second raised indexed orientation is adjacent to and angularly offset from the first indexed orientation by a full step, a discrete amount corresponding to the thickness of a tooth 33 between the face 34 and the back 35 of the tooth 33. The second raised indexed orientation is offset from the first lowered indexed orientation by a half step. In this cycle of discrete half steps of angular movement of the piston 12 and the nozzle 14, the nozzle 14 is directed cyclically through twelve discrete orientations about the head 10. The piston 12 reciprocates between raised and lowered positions to rotate the piston 12 and nozzle 14 discretely between each successive movement from the raised position to the lowered position, from the lowered position to the raised position, and so on. The piston 12 moves sequentially between the first raised indexed orientation, the first lowered indexed orientation, the second raised indexed orientation, the second lowered indexed orientation, and so on, with each movement rotating the piston 12 one half step further around with respect to the insert 11.

The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A device for use in a swimming pool structure, the swimming pool structure including a pool and a circulation system having a piping assembly and a pump for cyclically communicating water through the piping assembly between the pool and the pump, and the piping assembly terminating in a collar installed in the swimming pool structure, the device comprising:

an insert and an end cap coupled to the insert, the insert and end cap cooperating to define a chamber coupled in fluid communication to the piping assembly through an inlet in the end cap;

a piston including a nozzle, the piston carried within the chamber for reciprocal movement between a lowered position and a raised position in which the piston is in one of a plurality of indexed orientations and the nozzle is free of obstruction above the insert;

the piston rotates to an adjacent indexed orientation in response to reciprocation of the piston between the raised and lowered positions in response to the cyclical application of water flow through the chamber from the inlet to the nozzle; and upper and lower engagement assemblies prevent rotational movement of the piston with respect to the insert in the raised and lowered positions, respectively, of the piston.

2. The device according to claim 1, wherein the upper engagement assembly is separate from the lower engagement assembly.

3. The device according to claim 1, wherein:

the upper engagement assembly is carried by the insert and the piston; and the lower engagement assembly is carried by the piston and the end cap.

4. The device according to claim 1, further comprising a weight carried by the piston biasing the piston into the lowered position.

5. The device according to claim 1, wherein:

the upper engagement assembly comprises a first set of teeth carried on the insert and a second set of teeth carried on the piston for meshingly engaging with the first set of teeth of the upper engagement assembly to prevent relative rotational movement of the insert and the piston in the raised position thereof; and the lower engagement assembly comprises a first set of teeth carried on the piston and a second set of teeth carried on the end cap for meshingly engaging with the first set of teeth of the lower engagement assembly to prevent relative rotational movement of the insert and the piston in the lowered position thereof.

6. The device according to claim 5, wherein the first set of teeth of the lower engagement assembly includes half the number of teeth of the second set of teeth of the lower engagement assembly.

7. The device according to claim 5, wherein the second set of teeth of the upper engagement assembly are directed away from the first set of teeth of the lower engagement assembly.

8. The device according to claim 5, wherein the piston comprises:

a body including the nozzle, the second set of teeth of the upper engagement assembly, and a stem;

a cap including the first set of teeth of the lower engagement assembly, the cap releasably coupled to the stem of the body; and a weight carried between the body and the cap, and biasing the piston into the lowered position thereof.

9. The device according to claim 5, wherein the first set of teeth of the upper engagement assembly are offset from the second set of teeth of the lower engagement assembly.

10. The device according to claim 1, further comprising a minor outlet configured to communicate water from the inlet through the device into the pool.

11. The device according to claim 10, wherein in the raised and lowered positions of the piston, ports are formed in the upper and lower engagement assemblies, respectively, and couple the inlet in fluid communication with the minor outlet through the upper and lower engagement assembly, respectively.

12. The device according to claim 10, wherein the minor outlet is formed between the insert and the piston.

13. The device according to claim 12, wherein the minor outlet is an annular gap between the insert and the piston.

14. A device for use in a swimming pool structure, the swimming pool structure including a pool and a circulation system having a piping assembly and a pump for cyclically communicating water through the piping assembly between the pool and the pump, and the piping assembly terminating in a collar installed the swimming pool structure, the device comprising:

an insert having an inlet and configured to be applied to the collar;

a piston formed with a nozzle, the piston carried in the insert for reciprocal movement between a lowered position and a raised position into a first indexed orientation of the nozzle above the insert;

the nozzle rotates to a second indexed orientation, adjacent to the first indexed orientation, in response to the piston moving from the raised position to the lowered position to the raised position in response to the cyclical application, removal, and application, respectively, of water through the inlet;

upper and lower engagement assemblies prevent rotational movement of the nozzle with respect to the insert in the raised and lowered positions, respectively, of the piston; and a weight biases the piston into the lowered position.

15. The device of claim 14, further comprising a flange extending from the insert over the collar so as to conceal the collar in the swimming pool structure.

16. The device according to claim 14, wherein:

the upper engagement assembly is carried by the piston and the insert;

the lower engagement assembly is carried by the piston and the insert; and the upper engagement assembly is spaced apart from the lower engagement assembly.

17. The device according to claim 14, wherein:

the upper engagement assembly comprises a first set of teeth carried on the insert and a second set of teeth carried on the piston for meshingly engaging with the first set of teeth of the upper engagement assembly to prevent rotational movement of the piston in the raised position thereof; and the lower engagement assembly comprises a first set of teeth carried on the piston and a second set of teeth carried on the insert for meshingly engaging with the first set of teeth of the lower engagement assembly to prevent rotational movement of the piston in the lowered position thereof.

18. The device according to claim 17, wherein the first set of teeth of the lower engagement assembly includes half the number of teeth of the second set of teeth of the lower engagement assembly.

19. The device according to claim 17, wherein the first set of teeth of the upper engagement assembly are offset from the second set of teeth of the lower engagement assembly.

20. The device according to claim 18, further comprising a minor outlet configured to allow water to flow from the inlet through the device into the pool.

21. The device according to claim 20, wherein in the raised and lowered positions of the piston, ports are formed in the upper and lower engagement assemblies, respectively, and couple the inlet in fluid communication with the minor outlet through the raised and lower engagement assemblies, respectively.

22. A device for use in a swimming pool structure, the swimming pool structure including a pool and a circulation system having a piping assembly and a pump for cyclically communicating water through the piping assembly between the pool and the pump, and the piping assembly terminating in a collar installed in the swimming pool structure, the device comprising:

an insert and an end cap cooperating to define a chamber coupled in fluid communication to the piping assembly through an inlet in the end cap;

a piston including a weight and a nozzle, the piston carried within the chamber for reciprocal movement between a lowered position, into which the weight biases the piston, and a raised position, in which the piston is in one of a plurality of indexed orientations and the nozzle is free of obstruction above the insert;

the piston rotates to an adjacent indexed orientation in response to reciprocation of the piston between the raised and lowered positions in response to the cyclical application of water flow through the chamber from the inlet to the nozzle;

spaced-apart upper and lower engagement assemblies prevent relative rotational movement of the piston and the insert in the raised and lowered positions, respectively, of the piston; and a minor outlet formed between the insert and the piston is in fluid communication with the inlet to allow water to flow from the inlet, between the insert and the piston, and out the minor outlet.

23. The device according to claim 22, wherein:

the upper engagement assembly comprises a first set of teeth carried on the insert and a second set of teeth carried on the piston for meshingly engaging with the first set of teeth of the upper engagement assembly to prevent relative rotational movement of the piston in the raised position thereof; and the lower engagement assembly comprises a first set of teeth carried on the piston and a second set of teeth carried on the end cap for meshingly engaging with the first set of teeth of the lower engagement assembly to prevent relative rotational movement of the piston in the lowered position thereof.

24. The device according to claim 23, wherein in the raised and lowered positions of the piston, ports are formed in the upper and lower engagement assemblies, respectively, and couple the inlet in fluid communication with the outlet through the upper and lower engagement assemblies, respectively.

25. The device according to claim 24, wherein:

the first set of teeth of the lower engagement assembly includes half the number of teeth of the second set of teeth of the lower engagement assembly; and the first set of teeth of the upper engagement assembly are offset from the second set of teeth of the lower engagement assembly.

* * * * *